US005335824A

United States Patent [19]

Weinstein

[11] Patent Number: 5,335,824

[45] Date of Patent: Aug. 9, 1994

[54] SPRAY DEVICE WITH AMPOULE OPENING MECHANISM

[75] Inventor: Jack Weinstein, Manchester Township, Ocean County, N.J.

[73] Assignee: Primary Delivery Systems, Inc., Easton, Pa.

[21] Appl. No.: 102,818

[22] Filed: Aug. 6, 1993

[51] Int. Cl.[5] ..... B67D 5/00

[52] U.S. Cl. ..... 222/82; 222/83

[58] Field of Search ..... 222/81–83.5, 222/88, 87, 325, 378, 381, 383, 541, 548, 570, 536, 545

[56] References Cited

U.S. PATENT DOCUMENTS

| | | | |
|---|---|---|---|
| 3,214,069 | 10/1965 | Dike | 222/536 |
| 3,369,707 | 2/1968 | Porter et al. | 222/83 |
| 3,481,676 | 12/1969 | Schwartzman | 401/134 |
| 3,482,920 | 12/1969 | Schwartzman | 401/132 |
| 4,722,449 | 2/1988 | Dubach | 215/235 |
| 4,747,719 | 5/1988 | Parkin | 401/132 |
| 4,779,763 | 10/1988 | Klawitter | 222/82 |
| 4,784,506 | 11/1988 | Koreska et al. | 401/132 |
| 5,215,220 | 6/1993 | Kreiseder et al. | 222/83 |

FOREIGN PATENT DOCUMENTS

| | | | |
|---|---|---|---|
| 453492 | 9/1936 | United Kingdom | 222/83 |

*Primary Examiner*—Andres Kashnikow
*Assistant Examiner*—Philippe Derakshan
*Attorney, Agent, or Firm*—Kenneth P. Glynn

[57] ABSTRACT

The present invention is a spray container device for receiving, opening and spray dispensing liquid from an ampoule. It includes an upper container with a top, a bottom and side walls and has at least one top opening and at least a first bottom opening and a second bottom opening and has a vertical central axis of rotation. The top opening and bottom openings are off-centered from the central axis of rotation, the top opening and the first bottom opening being in vertical alignment so as to create a pump passage through the upper container for receiving a pump. The upper container further has an inside wall adjacent the second bottom opening of sufficient size and strength for breaking the top of an ampoule. There is also a lower container rotatably connected to and below the upper container. It has a top, a bottom and side walls and has at least one top orifice and at least one bottom orifice and has the same vertical central axis of rotation as the upper container. The top and bottom orifice are in alignment with one another and form a passage through the lower container which is adapted to receive a liquid-containing ampoule with a top of the ampoule protruding above the top of the lower container.

16 Claims, 3 Drawing Sheets

SPRAY DEVICE WITH AMPOULE OPENING MECHANISM

BACKGROUND OF THE INVENTION

1. Field of the Invention

The present invention is directed to a spray device with an ampoule opening mechanism. More specifically, the present invention is directed to a device which constitutes a container for an ampoule with a top on the container for both breaking the ampoule and bringing the open ampoule to a sprayer for subsequent application. In general, the device of the present invention may be used for any type of liquid spray dispensing, such as bug repellant, sun screen, topical medication, surgical scrub, chemical testing, etc.

2. Prior Art Statement

The ability to pierce or break or otherwise enter into an ampoule or container of solution at the time of its use enables a user to avoid evaporation, clogging and other applicator type dispensers. Thus, numerous devices have been developed for puncturing a subcontainer or ampoule with an applicator at the time of first use. For example, U.S. Pat. No. 3,481,676, issued to Schwartzman on Dec. 2, 1969 shows a system for piercing a subcontainer located within an applicator at the time of use by having an outer container with a series of bellows to enable the user to contract the container in such a way that a circular knife edge cuts into the inside container.

U.S. Pat. No. 4,747,719 to Parken describes a disposable topical application swab in which liquid which is initially stored within a tube or ampoule is pierced with a lance which is connected to the inside of an outer tube. In this case, the cap of the outer tube holds the swab applicator and when the cap is removed, the punctured ampoule and swab absorbent material is available for use. The cap in this prior art teaching has a first position and a second position, one for storing the inner tube in an unpierced position and the second for storage and piercing.

U.S. Pat. No. 4,784,506 issued to Koreska et al on Nov. 15, 1988, describes a device for applying a predetermined quantity of a liquid to a surface and involves the use of an applicator or swab as well as a breakable ampoule. There are two flexible blades located along the sides so that the outer container may be squeezed so as to pierce the ampoule and allow the liquid to then flow to the swab end of the device.

U.S. Pat. No. 3,482,920 to Schwartzman issued on Dec. 9, 1969 shows a swab type or blotter type applicator container wherein a sealed container of liquid is pierced at the time of use by depressing a cap which contains a piercing element which passes through the resilient material and breaks the end of the previously sealed container. When the cap is removed the applicator has liquid flowing in a free flow fashion to the absorbent material.

U.S. Pat. No. 4,722,449 issued to Dubach on Feb. 2, 1988 describes a container with a flip cap which includes a strip section on the cap which is removed and then the cap is pushed down so as to cause an orifice in the cap to pierce an otherwise sealed container to free liquid. While this patent shows multiple positions for the cap, it does not involve the use of an ampoule or a blotter material.

Notwithstanding the above cited prior art, the technology is lacking for a spray dispenser applicator which may break the ampoule and lock in the sprayer for subsequent spraying. Thus, the prior art neither teaches nor renders obvious the ampoule solution spray dispenser device of the present invention.

SUMMARY OF THE INVENTION

The present invention is a spray container device for receiving, opening and spray dispensing liquid from an ampoule. It includes an upper container with a top, a bottom and side walls and has at least one top opening and at least a first bottom opening and a second bottom opening and has a vertical central axis of rotation. The top opening and bottom openings are off-centered from the central axis of rotation, the top opening and the first bottom opening being in vertical alignment so as to create a pump passage through the upper container for receiving a pump. The upper container further has an inside wall adjacent the second bottom opening of sufficient size and strength for breaking the top of an ampoule. There is also a lower container rotatably connected to and below the upper container. It has a top, a bottom and side walls and has at least one top orifice and at least one bottom orifice and has the same vertical central axis of rotation as the upper container. The top and bottom orifice are in alignment with one another and form a passage through the lower container which is adapted to receive a liquid-containing ampoule with a top of the ampoule protruding above the top of the lower container. The upper container and lower container are adapted to be rotated relative to one another from a first position to a second position, the first position being wherein the second bottom opening of the upper container is located above the top orifice of the lower container, and the second position being wherein the first bottom opening of the upper container is located above said top orifice of the lower container, such that a user may insert an ampoule while the device is in its first position, rotate the upper and lower containers relative to one another so as to break off a top of the ampoule, rest the device in its second position and insert a spray mechanism into the device and ampoule for spray dispensing.

DETAILED DESCRIPTION OF THE PRESENT INVENTION

The present invention sprayer container device is directed to a simplified way of utilizing ampoule-containing medications and other liquids which may be sprayed but which must be maintained in an oxygen-free environment (i.e. enclosed in a sealed ampoule) until it is ready for use. Thus, it is an object of the present invention to provide a self-contained device which constitutes a system for receiving an ampoule, for receiving a spray mechanism, for rotating the device so as to break open the ampoule in a secured fashion, to relocate the broken head or tip of the ampoule away from the open top of the ampoule and to subsequently align and insert a spray mechanism for immediate use. Thus, the present invention will enable a user to insert an ampoule and to utilize same and subsequently dispose of the ampoule. In one embodiment it is presumed that the present invention device and broken ampoule are disposable and discarded together. In an alternative embodiment for controlled environment situations such as for laboratory purposes, the present invention device may be rotated back to a start position and the ampoule and broken glass may be disposed of with the device otherwise being sterilized and reused.

Figure 1:
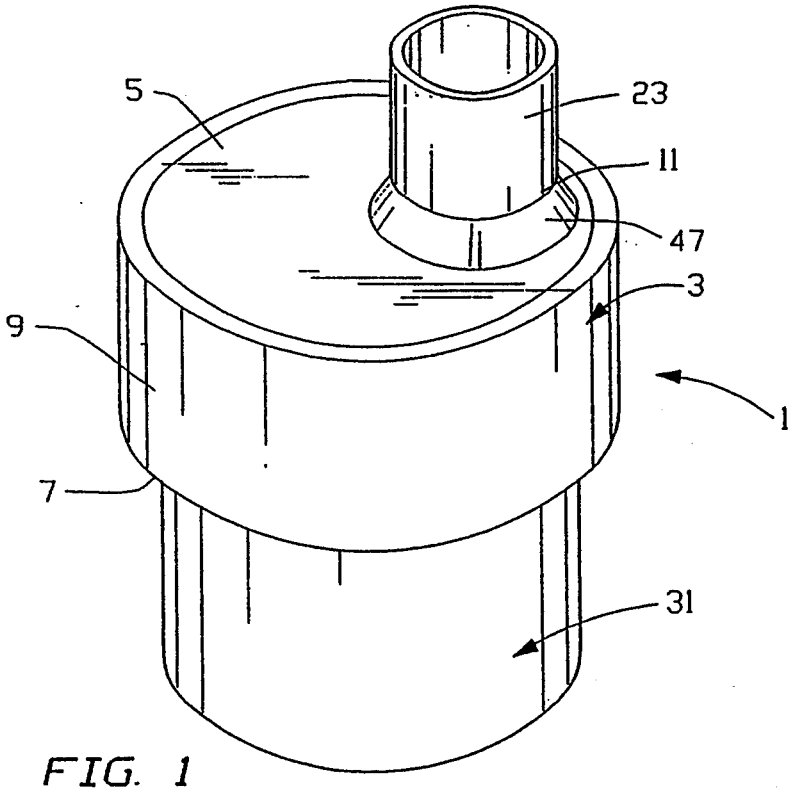
FIG. 1 shows an oblique front view of a present invention spray device without a spray pumping mechanism inserted and, FIG. 2 shows a front cut view of the present invention device shown in FIG. 1.
Figure 2:
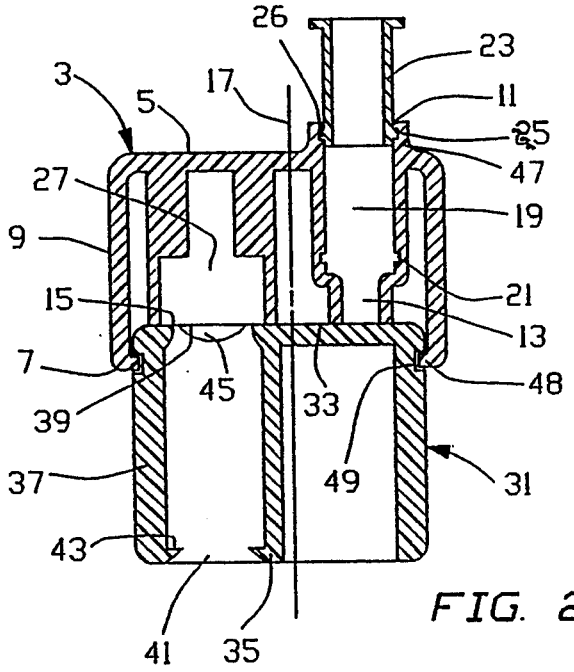

Referring now to FIG. 1, there is shown a first preferred embodiment present invention spray container device 1 having an upper container 3 and a lower container 31 as shown. Reference shall now be made to FIGS. 1 and 2 together wherein FIG. 1 shows a full, front perspective or oblique view of the present invention device 1, whereas FIG. 2 shows a front cut view of the same device 1.

Upper container 3 has a top 5 and a bottom 7, as well as a side wall 9. There is a top opening 11 located in top 5 and, in bottom 7 there is a first bottom opening 13 and a second bottom opening 15. First bottom opening 13 is in direct alignment with top opening 11 and creates a pump passage 19 therein as shown. There is a pump passage stop 21 which prevents collar 23, shown in its upward position from going no further than stop 21 when it is pushed down in its second, lower position. Pump collar 23 is shown in its first position with stop 25 being inserted in cut-out 26 which is within the upper portion of neck 47, as shown. The second bottom opening 15 is adapted to receive the top of an ampoule and includes an inside wall 27 which is adequate strength to maintain its integrity sufficiently to break off the top of an ampoule inserted therein.

Lower container 31 includes top 33 and bottom 35 with side wall 37. There is a top orifice 39, and this is located in alignment with a bottom orifice 41, together adapted to receive an ampoule so that an ampoule top would protrude out the top orifice 39. Tapered lip 43 would hold the ampoule in place and ampoule recess 45 would assist in the breaking off of an ampoule top. There is a vertical central axis of rotation 17 and, due to rotation guide interlock 48, here a male protrusion on upper container 3, and recess guide interlock 49, here cut-out ring on a top of lower container 31, for rotating upper container 3 relative to lower container 31.

A user would insert an ampoule into bottom orifice 41 and past tapered lip 43 so that the ampoule sits within lower container 31 with its top protruding into the second bottom opening 15 of upper container 3. A sprayer mechanism such as a pump spray with a dip tube, would be inserted into collar 23 and the dip tube would not protrude below first bottom opening 13 while collar 23 was in its upper position as shown. The user would rotate the upper container 3 relative to bottom container 31 and inside wall 27 would force the top of the ampoule off and break open the neck of the ampoule. The rotation would continue until alignment of first bottom opening 13 was with top orifice 39 (a rotational stop, not shown, could be included in interlock 49 to achieve the alignment).

The user would then push down on collar 23 so as to lower it into its second, lower position and the dip tube of the sprayer mechanism would insert into the ampoule and the device 1 would be ready for use. A user would then use the sprayer to consume the contents of the ampoule as desired.

Figure 3:
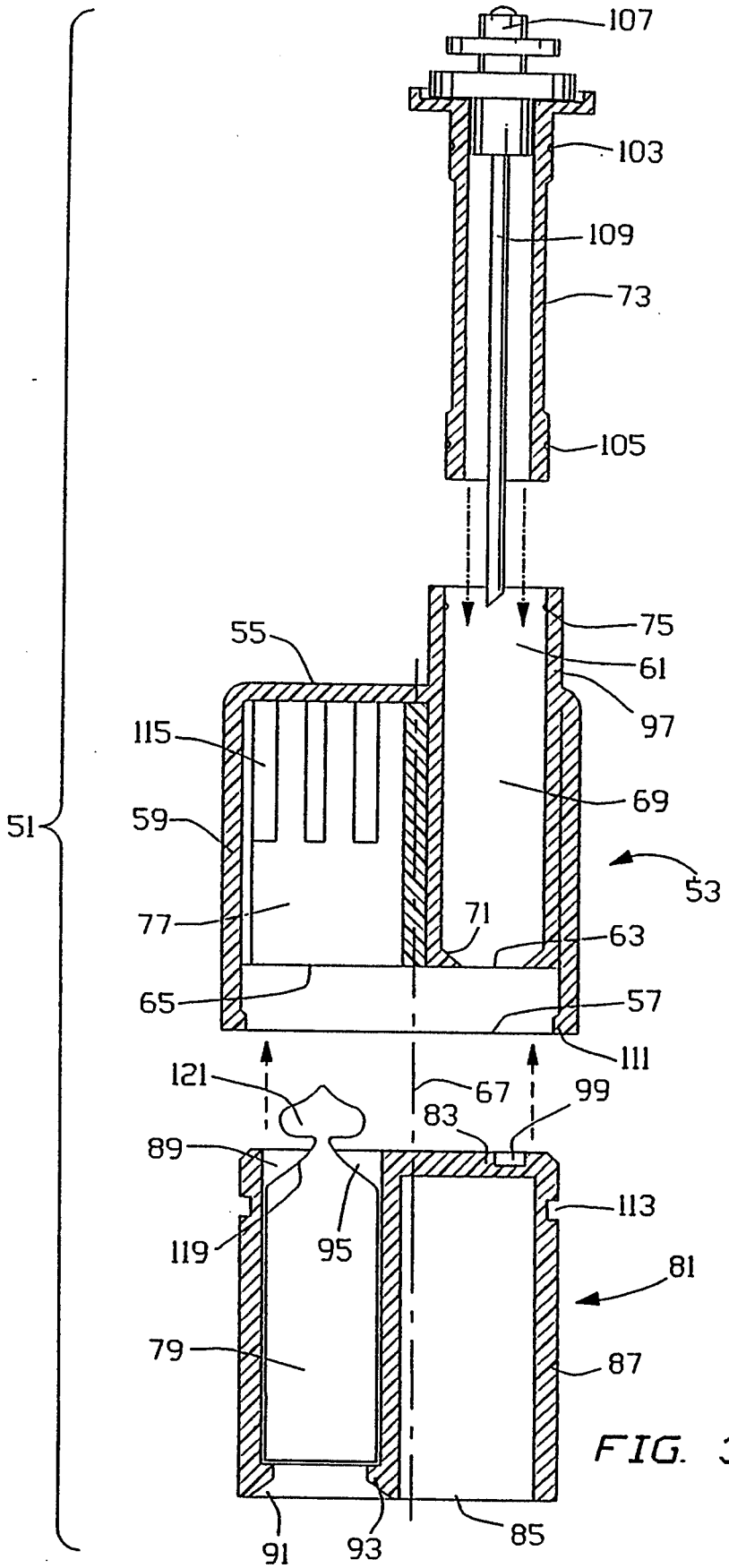
FIG. 3 shows a side cut view of an alternative embodiment complete present invention device with a pump collar and pumping mechanism included.
Figure 4:
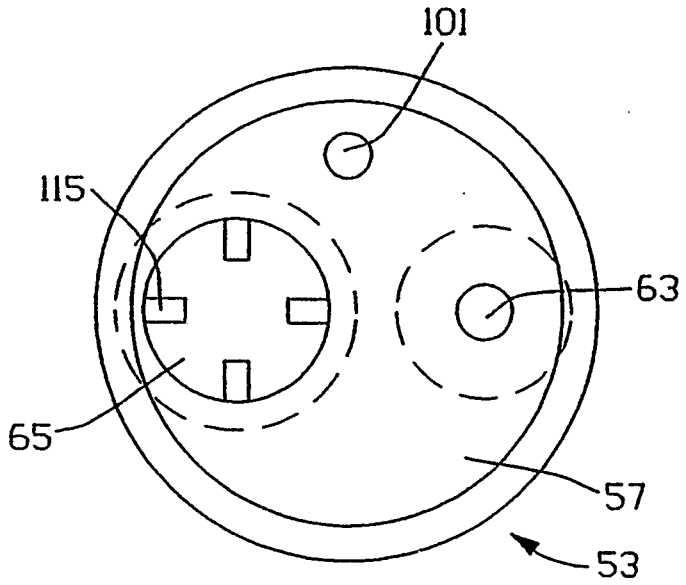
FIG. 4 shows a bottom view of the upper container shown in FIG. 3.
Figure 5:
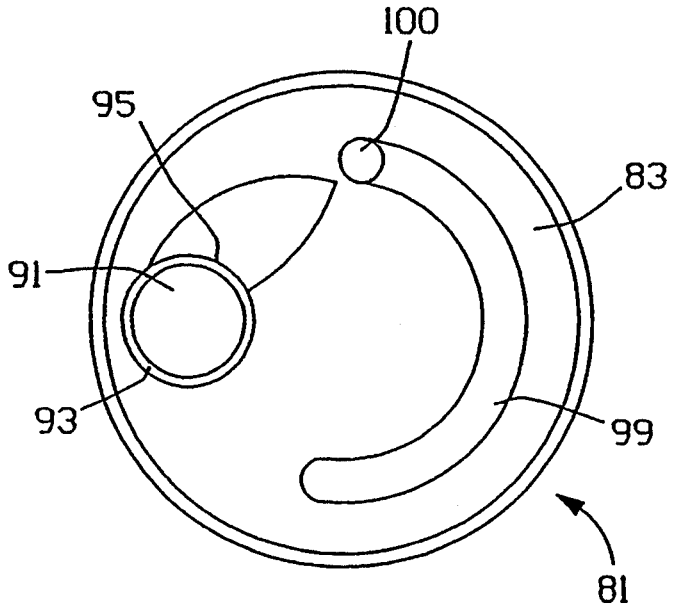
FIG. 5 shows a top view of the lower container of the present invention sprayer device shown in FIG. 3.

Referring now to FIG. 3 there is shown a front cut view of a complete present invention spray device 51 in a blown up part configuration. FIG. 4 shows a bottom view of upper container 53 and FIG. 5 shows a top view of lower container 81 and FIGS. 3, 4 and 5 shall be discussed together. Here, spray container device 51 includes upper container 53 with a top 55 and a bottom 57 as well as side wall 59. There is a top opening 61 located in the top 55 of upper container 53 as well as a first bottom opening 63 and a second bottom opening 65 located in the bottom 57. Note, again, that the first bottom opening 63 and the top opening 61 are in alignment and create a pump passage 69. There is pump passage stop 71, as shown as well as pump collar 73. There is also an upper stop 75 which coincides with spray collar second stop recess 105 when collar 73 is in its upper position and with spray collar second stop recess 103 when collar 73 is in its second, lower position There is an inside wall 77 adapted to break an ampoule head, as discussed below. There is a central axis 67 which is a vertical central axis of rotation for both upper container 53 and lower container 81. Lower container 81 has a top 83, a bottom 85 and a side wall 87. There is a top orifice 89 and bottom orifice 91, which are in alignment, as shown. There is an ampoule 79 located therein having a neck 119 and a top 121. Tapered lip 93 contains ampoule 79 within lower container 81 when the ampoule is inserted therein. There is also a recess 95 to assist in the breaking off of ampoule top 121. There is also a neck 97 which extends above the top 55 upper container 53 to provide additional height or length to accommodate the length of dip tube 109 of sprayer pump mechanism 107.

Arcuated track 99 controls the rotation of the upper container relative to the lower container and assures that, when rotated in its second position, after the ampoule has been broken, that first bottom opening 63 is in direct alignment with the broken off ampoule and top orifice 89. An optional lock set 100 will cause peg 101 to lock therein to maintain the second position, if desired. Thus, if lock position inset 100 is not included, the device may be rotated back and forth, whereas, if inset 100 is included, the device will be presumed to have a single use disposable mode.

There is an interlock 111 and an interlock 113, the first being a male and the second being a female, although these could be reversed. These are interlock guides to assure that the upper container 53 and the lower container 81 are locked into one another, are rotatable relative to one another and that peg 101 is properly inserted into arcuated track 99 for use. Ampoule stops such as ampoule stop 115 are optionally included to inhibit the ampoule from being pushed too far into the device. Quickly referring back to FIG. 2, as an alternative to stop walls such as ampoule stop 115, a tapered collar at the top orifice of the lower container could be used. Other types of conventional stops and holding mechanisms could likewise be used.

Obviously, numerous modifications and variations of the present invention are possible in light of the above teachings. It is therefore understood that within the scope of the appended claims, the invention may be practiced otherwise than as specifically described herein.

What is claimed is:

1. A spray container device for receiving, opening and spray dispensing liquid from an ampoule, which comprises:

(a.) an upper container having a top, a bottom and side walls and having at least one top opening and at least a first bottom opening and a second bottom opening and having a vertical central axis of rotation, said top opening and bottom openings being off-centered from said central axis of rotation, said top opening and said first bottom opening being in vertical alignment so as to create a pump passage through said upper container for receiving a pump, said upper container further having an inside wall adjacent said second bottom opening of sufficient size and strength for breaking the top of an ampoule;

(b.) a lower container rotatably connected to and below said upper container, said lower container having a top, a bottom and side walls and having at least one too orifice and at least one bottom orifice and having the same vertical central axis of rotation as said upper container, said one top and one bottom orifice being in alignment with one another and forming a passage through said lower container adapted to receive a liquid-containing ampoule with a top of said ampoule protruding above the top of said lower container;

whereby said upper container and lower container are adapted to be rotated relative to one another from a first position to a second position, said first position being wherein said second bottom opening of said upper container is located above said top orifice of said lower container, and said second position being wherein said first bottom opening of said upper container is located above said top orifice of said lower container, such that a user may insert an ampoule while said device is in its first position, rotate said upper and lower containers relative to one another so as to break off a top of said ampoule, rest the device in its second position and insert a spray mechanism into said device and ampoule for spray dispensing.

2. The device of claim 1 further including a pump collar inserted into said pump passage, said collar having a first, upper position within said pump passage, and having a second, lower position in said pump passage, said first, upper position restricting insertion of a spray pump mechanism to only the upper container, and said second, lower position permitting insertion of a spray mechanism to both the upper container and the lower container.

3. The device of claim 1 wherein one of said upper and lower containers has an arcuated track and the other of said upper and lower containers has a protrusion coincidental with and inserted into said track to guide rotation of the device from its first position to its second position.

4. The device of claim 2 wherein one of said upper and lower containers has an arcuated track and the other of said upper and lower containers has a protrusion coincidental with and inserted into said track to guide rotation of the device from its first position to its second position.

5. The device of claim 1 further including a spray pump mechanism.

6. The device of claim 2 further including a spray pump mechanism.

7. The device of claim 3 further including a spray pump mechanism.

8. The device of claim 4 further including a spray pump mechanism.

9. The device of claim 2 further including a spray pump mechanism which is permanently connected to said collar and extends below said collar so as to remain in said upper container when said collar is in its first position and extends into said lower container when said collar is in its second position.

10. The device of claim 3 wherein further including a pump collar inserted into said pump passage, said collar having a first, upper position within said pump passage, and having a second, lower position in said pump passage, said first upper position restricting insertion of a spray pump mechanism to only the upper container, and said second, lower position permitting insertion of a spray mechanism to both the upper container and the lower container.

11. The device of claim 10 wherein further including a pump collar inserted into said pump passage, said collar having a first, upper position within said pump passage, and having a second, lower position in said pump passage, said first upper position restricting insertion of a spray pump mechanism to only the upper container, and said second, lower position permitting insertion of a spray mechanism to both the upper container and the lower container.

12. The device of claim 4 wherein further including a pump collar inserted into said pump passage, said collar having a first, upper position within said pump passage, and having a second, lower position in said pump passage, said first upper position restricting insertion of a spray pump mechanism to only the upper container, and said second, lower position permitting insertion of a spray mechanism to both the upper container and the lower container.

13. The device of claim 2 further including removable locking means located about said collar to prevent its movement from its first position to its second position.

14. The device of claim 4 further including removable locking means located about said collar to prevent its movement from its first position to its second position.

15. The device of claim 6 wherein removable locking means is located about said collar to prevent its movement from its first position to its second position.

16. The device of claim 8 further including removable locking means located about said collar to prevent its movement from its first position to its second position.

* * * * *